US006907686B2

(12) United States Patent
Symons

(10) Patent No.: US 6,907,686 B2
(45) Date of Patent: Jun. 21, 2005

(54) PORTABLE FRAMING GALLERY

(75) Inventor: Michael Symons, Campbell, CA (US)

(73) Assignee: Kensington Art Centre, Inc., Campbell, CA (US)

( * ) Notice: Subject to any disclaimer, the term of this patent is extended or adjusted under 35 U.S.C. 154(b) by 0 days.

(21) Appl. No.: 10/366,737

(22) Filed: Feb. 14, 2003

(65) Prior Publication Data

US 2004/0159030 A1 Aug. 19, 2004

(51) Int. Cl.[7] ..... A47G 1/06
(52) U.S. Cl. ..... 40/700; 40/768; 40/772
(58) Field of Search ..... 40/700, 768, 772; 434/72; 206/575

(56) References Cited

U.S. PATENT DOCUMENTS 3,382,595 A * 5/1968 Shore ..... 40/769
4,057,923 A 11/1977 Chase
4,424,637 A 1/1984 Leahy
4,685,699 A 8/1987 Hirasawa
5,383,293 A * 1/1995 Royal ..... 40/768
5,400,532 A 3/1995 Grove
5,404,663 A * 4/1995 Schober ..... 40/768
5,783,005 A * 7/1998 Handler ..... 40/700
5,893,229 A * 4/1999 Werner ..... 40/773
5,950,922 A * 9/1999 Flinn ..... 40/768
6,460,280 B1 * 10/2002 Haines-Woon ..... 40/768

* cited by examiner

*Primary Examiner*—Gary C. Hoge
(74) *Attorney, Agent, or Firm*—Burns Doane Swecker & Mathis, L.L.P.

(57) ABSTRACT

A portable model picture framing gallery comprising an easily carried box containing multiple image cards, multiple mat cards, one or more transparent protective covers, and multiple frame cards. The image cards contain preselected representations of artwork images manipulated to a predetermined size, the mat cards are of a variety of colors and textures, the transparent cover can be non-glare or regular glass or plastic, and framing cards are each imprinted with representation of a frame. The user selects an image card, one or more mat cards, a protective cover, and a suitable frame card to view a representation of the custom framed image suitable for placing an order.

18 Claims, 2 Drawing Sheets

PORTABLE FRAMING GALLERY

BACKGROUND

The present invention relates to a portable model image framing gallery holding multiple representations of artwork images such as prints, as well as mats, and depictions of frames sized so that they can be conveniently taken to a customer's location for display and selection.

DESCRIPTION OF THE PRIOR ART

Presently, artwork framing galleries must have a large amount of wall space for displaying a large number of prints, mats, and a wide selection of frames and frame corners suitable for viewing by prospective purchasers. The artwork, prints or pictures come in a wide variety of sizes, measuring from inches on a side up to several feet in each dimension. Similarly, mats come in a wide variety of textures and colors as well as cuts. And, frames have an almost unlimited variety of styles, sizes and colors. Thus, to have a suitable display, a framing gallery traditionally must maintain a large inventory of the variety of components and have sufficient wall space for displaying them. Another difficulty with a traditional framing gallery is that a prospective customer must travel to the physical location of the framing gallery in order to adequately assess the interrelationship between the artwork, the mats, and the frames in order to make a selection. The alternative of viewing and selecting the prints and mats and frames from a distance, such as over the internet, does not provide the satisfaction of physical viewing of the print, mat and frame that many customers desire.

SUMMARY OF THE INVENTION

In view of the foregoing, one aspect of the invention is to provide a portable model artwork framing gallery for images that can be easily taken to a customer's site for display. The invention provides a portable image selection and framing gallery which preferably can be carried in a box to a customer's location and which can be outfitted with a variety of cards containing preselected representations of images, mats in the form of mat cards, frame cards containing depictions of frames, and optionally, frame samples suitable for the viewing by the customer. For example, boxes can be outfitted with preselected representations of images for various venues, for example, residential decor, a children's room, a corporate headquarters, or based on various themes such as art deco, impressionist, cowboy, or pastoral.

The portable model framing gallery, in one embodiment, comprises a plurality of interchangeable image cards, each containing a representation of a preselected artwork image; a plurality of interchangeable mat cards, and a plurality of interchangeable frame cards, each containing a depiction of a frame, and preferably, one or more transparent protective covers. Generally, the user will select an image card, one or more mat cards to place over the image card, optionally a protective cover such as non-glare acrylic, and finally a frame card having the depiction or appearance of a frame imprinted on it, such that when the cards are placed on one another, the user will have a representation or model of the display of the finished framed artwork Each of the various components of the gallery (e.g., image, image card, mat card, protective cover and frame card) are of a predetermined size or exterior dimension, such that each of the components items can be interchanged with another item of the same component, and preferably all components are of a size to fit into a container or carrying box. Preferably, the cards and protective covers are of the same size or exterior dimensions, which in a further preferred embodiment is square. The interchangeability of the components allows the user to compare the appearance of various types of mats and frames in connection with a selected image, such that a suitable determination can be made on the finished product of print, mat, protective cover and frame, and what should be ordered.

Another benefit of the present invention is to provide a user with a selection of choices of artwork images, mats and frames in a portable and compact kit, and further to provide a selection of a custom-framed prints at an affordable price by eliminating the need for large retail space for displaying sample framed images, frame corner samples, a variety of mats, and also eliminating the need for maintaining an inventory of large, heavy art print catalogues. The invention allows one to maintain a custom framing shop at a central location, while being able to provide a distant customer with a visual representation of the framed artwork, and ultimately, a custom-created framed image.

Still another benefit of the present invention is the ability to promote increased sales of high quality custom framed art with minimal investment in inventory and staff training. The invention overcomes the need for the customer to travel to the physical location of the framing gallery to make a selection. By providing a model artwork image framing gallery and custom frame selection center, the model gallery can be carried to a customer's location and used as an interactive sales tool for selection of images, mats, and design of custom frames. Alternatively, remote locations without a population density to support a traditional framing gallery can use the model framing gallery in a store setting to provide customers with an up-to-date and wide selection of images, mats and frames without the expense of the inventory of standard size images and frames. Other and further aspects will be apparent as a description proceeds and upon reference to the accompanying drawings wherein:

DESCRIPTION OF THE PREFERRED EMBODIMENTS

Figure 1:
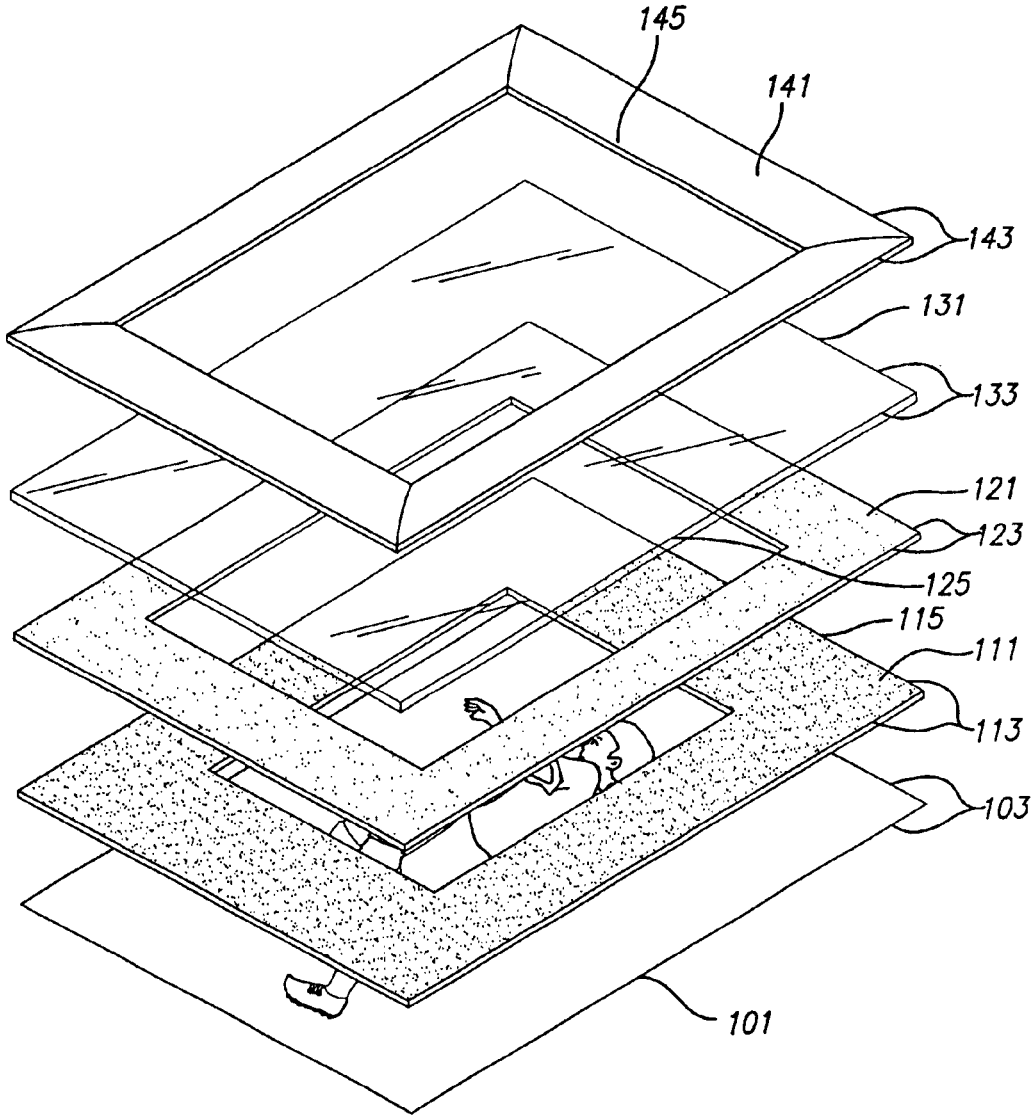
FIG. 1 is a perspective view of components of a preferred embodiment and method of assembly of a representation of a framed artwork image.

In one embodiment, the invention comprises a selection of representations of artwork images. The representations have been manipulated to a predetermined size. The artwork image can be any image suitable for framing, such as a print, lithograph, photograph, an original painting or a sketch, a representation of which has been adapted to the predetermined size and the representation imprinted on a card, typically positioned in the center of the card. A variety of representations of images will be imprinted, each on a card of a predetermined size, preferably rectangular or square, although round or oval is within the scope of the invention. The sources for the images can be those provided from print catalogues supplied by Bruce McGaw, New York Graphics, or Editions Limited, or any other suitable source from whom copyright permission has been obtained. Alternatively, the images can be obtained in digital form from the proprietor using the internet, or a fixed digital medium.

The representations of the artwork images are prepared for use in the portable gallery by manipulating the horizontal and vertical dimensions. The representations of these images, in digital form, are manipulated to a predetermined size, using, for example, Adobe PHOTOSHOP software, Microsoft PAINT software, or other suitable image manipulation programs. Typically, the representation of the image will be manipulated on a horizontal axis to a first predetermined dimension, and the vertical dimension of the representation of the image will be manipulated to a second predetermined dimension, so that substantially all of the resulting representation of the artwork image will be viewable through an opening in the mat card. If the opening in the mat card is square, the first and second dimensions will be equal, such that the representation is square. If the opening in the mat card is rectangular, the first and second dimensions will likely not be equal. No matter what the dimensions of the original image or print are, for the purposes of allowing interchangeability , representations of all of the selected images will be manipulated to a substantially predetermined size, for example, by cropping, compressing or expanding the representation of the image along one or both dimensions, or a combination of these techniques. While the ultimate shape of the manipulated image is likely to be either rectangular or square, it is most convenient for it to be square.

Even though the image may be compressed, when the representation is presented and viewed within a mat card and a frame card, the viewer will have a fairly accurate representation of the colors and overall appearance of the original image. The compression of a representation of the image to a predetermined shape and size, for example, a rectangle or a square, allows a superior determination of compatible mat and frame colors, textures and styles than if selected images were just arbitrarily cropped to the predetermined size.

In addition, there will be a plurality of mat cards of a predetermined exterior size. The mat cards are preferably stock mat material, although they may be of any material embossed with the appearance of a mat. Traditionally, mats are made of cardboard, heavy paper stock, or plastic materials with at least one aesthetically pleasing surface. The visible surface of the mat card can be any color and texture that a normal mat can be. Each of the mat cards will have a central opening adapted to permit viewing of the selected image. In one aspect, the plurality of mat cards will have the same size of interior opening. In another aspect, the plurality of mat cards will contain at least two groups of cards, one group having an interior opening of a first predetermined size, and the other group or groups each having an interior opening of a different size, such that when a mat with an interior opening of a first size is placed over a mat card with an interior opening of a second, different size, the mat card with the larger interior opening will "frame" or display the mat card with the smaller interior opening. When the portable model gallery or kit includes mat cards with two predetermined sizes of openings, one opening being slightly larger than the other, this arrangement will facilitate display of contrasting mat colors bordering the image.

Preferably, the portable gallery will also contain a transparent protective cover of a predetermined size to fit over both the mat card and the image card. The transparent protective covers can be made of non-glare glass or acrylic plastic, common glass, acrylic plastic, polycarbonate plastic, cellulose acetate plastic, polypropylene plastic, polystyrene plastic or other plastic material.

Further, there will be a plurality of pre-selected frame cards of predetermined size, each card being embossed with the appearance or depiction of a frame and adapted to fit at least a portion of, and preferably all of, the perimeter of the selected mat cards. Depictions of a frame are imprinted on at least one side of each frame card. The depiction of the frame may, but typically does not, extend to the exterior dimension of the frame card, except for depictions of very wide frames. The frame card has a central opening defined by an inner border of the frame depiction. The central opening allows display of the selected image card and the selected mat card or cards.

Similarly, in another aspect, in order to adequately present frames of different textures, colors, and widths, the portable gallery will have a selection of frame cards imprinted with depictions of frames which have been manipulated from the actual frame dimensions to those used for the frame card in the gallery. In one aspect of the invention, where the image and mat cards are square, the frame depiction will be manipulated or reduced in size from a square initial image to a predetermined size on the frame card. In another aspect of the invention, a digital image can be taken of the typical corner portion frame display, and that image manipulated to form the frame depiction of suitable dimensions.

The depiction of the frame is imprinted on the frame card such that the inner border of the frame is the boundary of the inner opening in the frame card. Typically, the depiction of the frame will not occupy all of the top surface of the frame card, and there is commonly space bordering the exterior dimension of the frame card that is not imprinted. Depictions of relatively narrow frames, when placed on a frame card, will have more free space between the outside edge of the card and the outer edge of the depiction than will the depiction of a frame which is relatively wide.

For example, to proportionately depict a print image that is in reality two feet high and three feet wide, the image will be reduced in size to 5 inches square, centered on an image card which is 7.5 inches on a side. If a single mat card is used, the interior opening of the card will be about 3.5 inches and the exterior 7.5 inches square. If two mat cards are used, the lower mat card will have an opening of about 3.375 inches square, and the upper mat card will have an interior opening 3.625 inches square, with the exterior dimension of both cards being 7.5 inches square. The protective acrylic cover is 7.5 inches square, and the interior opening of the frame card is 5 inches square, and the exterior is 7.5 inches square. When the frame card is overlain on the acrylic which is overlain on the mat card, which is overlain on the image card, the finished model allows the viewer to visualize the color scheme, patterns and textures to determine whether they are suitable for the viewer's needs.

It is to be understood that although the invention has been described from the standpoint that the predetermined sizes of the cards will be substantially square, it is equally possible for them to be rectangular, and it is further within the skill of the art to adapt the invention for use with cards whose overall shape is, for example circular or oval. Likewise, the invention is similarly adaptable when the image and central openings are rectangular, circular or oval.

In yet another embodiment, the invention relates to a method of displaying depictions of frames in conjunction with representations of artwork images, which comprises the steps of (a) displaying a plurality of representations of artwork images of predetermined size, and allowing selection of one of the plurality of representations, (b) displaying a plurality of mat cards of a predetermined size, the mat card having an internal opening sized to accommodate viewing of the selected image, and allowing selection of at least one of the mat cards, and (c) displaying a plurality of frame cards imprinted with a depiction of a frame and adapted to fit at least a portion of the perimeter of the representation of an artwork image card on the image card, and allowing selection of one of the frame cards such that when the frame card is overlaid on the mat card, which is in turn overlaid on the image card, there is a representation of a framed and matted artwork image. Preferably the method also allows displaying a plurality of transparent protective covers, and allowing selection of the transparent protective covers.

In still another embodiment, the invention comprises a portable model image framing kit comprising (a) a multiplicity of representations of pre-selected images of a first predetermined size centrally positioned on the face of the card of a second predetermined size, (b) a multiplicity of mat cards of a third predetermined size, each of the mat cards having a central opening adapted to display the representation of a selected image when the mat card is overlaid on the selected image card, and (c) a multiplicity of frame cards each having imprinted thereon a depiction of a frame, and having an inner border defining a central opening that allows display of at least a portion of the mat card when the frame card is superimposed on the mat card, and said frame card having a depiction of the frame bordering at least a portion of the central opening. In one aspect, the image card is the same exterior dimensions as the mat card, although it is possible that the depiction of the image is coextensive with the image card, and the image card fits within the opening of the mat card.

In yet another embodiment, the framing kit will contain actual samples of the frame stock, and the samples can be conveniently mounted several to a card of the same dimensions as the other cards The frame sample will be a small piece of the actual frame, which typically can be made from wood, metal, plastic or composites and can be of any shape and color available to the trade or desired by a customer. In yet another embodiment, the framing gallery will additionally contain a price sheet for the various artwork images, mats, frames, and transparent protective covers. In yet another embodiment, once an image, a mat, a transparent protective cover and a frame have been chosen, these can be ordered from a manufacturing facility by using a computer network or telecommunications system.

DETAILED DESCRIPTION OF THE DRAWINGS

FIG. 1 is a representative assemblage of the components of a model framed artwork image according to one embodiment of the present invention. Print or artwork image card 101 is one of a set of representations of pre-selected artwork images or prints. The size of the representation has preferably been manipulated from the size of the original image to a predetermined size. The actual image or print can be anything, such as a portrait, a landscape, still life, or any other desired image. The image card will have edges 103 of predetermined dimensions, which in this particular instance are substantially square in configuration, although a rectangular configuration is also suitable.

Adapted to be positioned over upon image card 101 is a lower mat card 111 having sides 113 which are substantially linear and square in configuration such that the lower mat card fits on top of image card 101. The interior opening 115 of the lower mat card is adapted to display a substantial portion of the image on image card 101, although the outer edges of the image will be overlain by the mat card. In this instance, the interior opening of the lower mat card is square, and the opening of the mat is cut along either the vertical or on an angle so as to display the color of the interior of the mat card.

Upper mat card 121 is preferably of a contrasting color to bottom mat card 111, and top mat card 121 can be of any color, texture or material available to the trade. The outside dimensions of exterior 123 of the upper mat card are preferably substantially the same as the predetermined size or outside dimensions of the bottom mat card 111 and image card 101, although it is possible to make any of them smaller or larger to nestle in with the card on top or on bottom of it. The interior opening 125 of the upper mat card is preferably square in size and may be cut vertically or at an angle to display the material making up the interior of the mat card.

The transparent protective cover 131 overlays the mat card or cards 121 and 131, as well as the image card 101, and serves to display the final appearance of the framed image. The dimensions of the exterior perimeter 133 of the transparent cover 131 are sufficient to cover the visible portion of the image as well as the overlaying mat or mats, and preferably are of the common predetermined dimension of the exterior of the mat card or cards and the image card.

The frame card 141 is imprinted on at least two adjacent sides, and preferably on all four sides, with a depiction of a picture frame. The exterior dimensions 143 of the frame card are substantially square, and of a predetermined size, preferably the same size as the protective cover 131, and upper and lower mat cards 121 and 111. The interior opening of 145 of frame card 141 is substantially square and sized to permit viewing of the underlying mat cards and image on the image card.

In one aspect, the exterior dimensions of the image card, mat card or cards, protective cover and frame cards will be substantially the same such that they can all fit within the confines of a carrying box. In another aspect, the image card could be relatively small so as to fit within a slot on the rear of a mat card, and the overall size of the frame card can be larger than that of the mat cards. In such a case, it is preferable to size the carrying box to accommodate both the larger frame card and include padding or spacers to accommodate the image cards, mat cards frames cards and transparent covers so that they all will fit snuggly within the carrying box.

Figure 2:
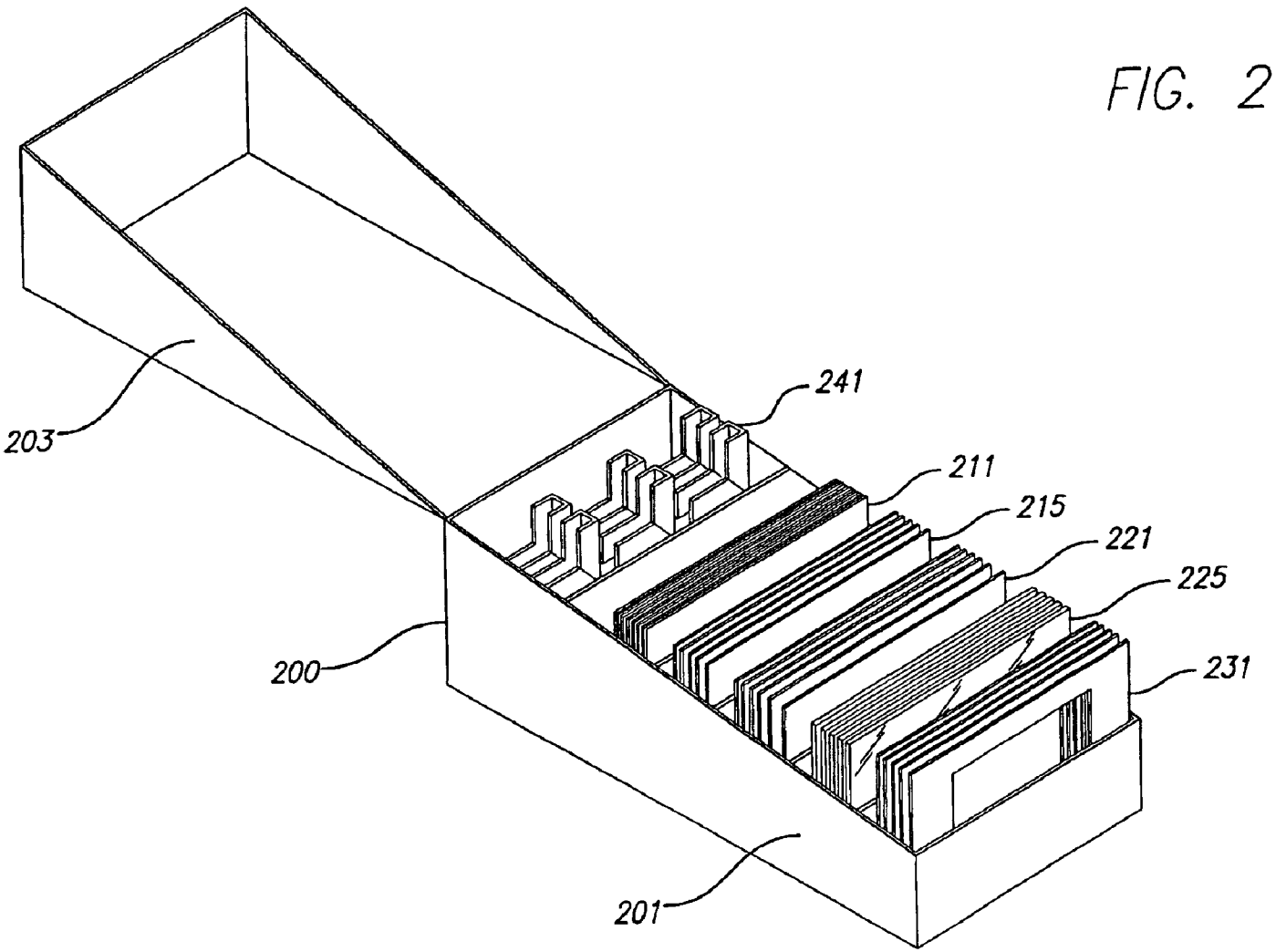
FIG. 2 is a perspective view of an arrangement of the contents of a model framing gallery.

Referring now to FIG. 2, there is portable container or box 200 for the portable model framing gallery, the box having a body portion 201 and a movable top or lid 203. Box body 201 and lid 203 can be made of any suitable material such as cardboard, metal, wood, plastic, composite or any combinations of them. The box is preferably square or rectangular in configuration. Within box 200 may be found dividers separating the interior into sections for holding various components of the framing gallery, namely section 211 for containing the image cards, section 215 for the lower mat cards, section 221 for the upper mat cards, section 225 for the transparent protective cover, section 231 for the frame cards, and preferably section 241 for samples of the frames or cards on which samples of the frames are mounted. In yet another embodiment, the box may additionally contain an index card of the print images, approximately 30–80 and preferably about 50 pre-selected print images; approximately 10–50 and preferably about 30 lower mat cards; approximately 10–50 and preferably about 30 upper mat cards; one and preferably at least 2 transparent protective covers, for example, ⅛ inch thick acrylic and non-glare glass; and 20–70, preferably about 40 frame cards; and preferably representative sample pieces of frames, as well as customer order forms, customer retail pricing sheets, simple instructions on how to use the portable framing gallery, simple design tips, and reorder forms for the contents.

In operation, the portable model framing gallery could be transported to a customer's location, where the customer would select one of the representations of an artwork images, either from the image cards themselves or the image index card, then pick a lower mat card and lay it on top of the image card, then pick an upper mat card and lay it on top of the lower mat card, pick a sample of the transparent protective cover and lay it on top of the upper mat card, and finally, pick a frame card and overlay it on the protective cover. Any of the components can be removed and replaced with an alternate selection at any time. Once the components of the desired framed image are identified, an order can be placed for the selected image, mats, frame and transparent cover over a telephone, by fax or a computer network to a production facility by using stock keeping numbers associated with the various components.

It should be appreciated that the present invention is not limited to any particular overall shape or configuration of the box or cards. Also, it should be realized that the invention is not limited to any particular number, size or shape of cards or images included in the box. The foregoing description is merely representative of specific preferred embodiments of the invention and is not intended to limit the scope of equivalent structures or arrangements. Thus, the invention is not intended to be limited by the description in the specification, but rather is defined by the claims and equivalents thereof.

What is claimed is:

1. A plurality of models of framed artwork images, each model comprising:

a representation of an artwork image having a first predetermined size and shape;

one or more mat cards, each having a second predetermined size and shape and each having an opening adapted to permit viewing one of the representations of the artwork images;

a frame card having a third predetermined size and shape and being imprinted with a frame depiction, each frame card having an opening defined by an inner border of the frame depiction which fits over at least a portion of a mat card; wherein the plurality of models fashion a portable artwork framing gallery, wherein the first predetermined size and shape are the same size and shape as the second predetermined size and shape, and wherein the third predetermined size and share are the same size and shape as the first predetermined size and shape.

2. The models as claimed in claim 1 further comprising a plurality of transparent protective covers of a predetermined size fitting between the mat card and the frame card.

3. The models as claimed in claim 1 wherein the representations of artwork images have a horizontal and a vertical dimension, and the size of the representations has been manipulated such that the vertical dimension is a predetermined height and the horizontal dimension is a predetermined width.

4. The models as claimed in claim 3 wherein the predetermined height is substantially equal to the predetermined width.

5. The models as claimed in claim 1 wherein the depiction of the frame on the frame card has been manipulated such that the width of the frame depiction is similar on all sides of the frame card.

6. A portable model artwork framing gallery comprising:

a plurality of representations having a first predetermined size and shape of artwork images;

a plurality of mat cards each having a second predetermined size and shape and each having an opening adapted to permit viewing one of the representations of artwork images; and a plurality of frame cards each having a third predetermined size and shape and being imprinted with a frame depiction, each of the frame cards having an opening defined by an inner border of the frame depiction which fits over at least a portion of one of the mat cards, wherein the first predetermined size and shape are the same size and shape as the second predetermined size and shape, and wherein the third predetermined size and shape are the same size and shape as the first predetermined size and shape.

7. The portable model artwork framing gallery as claimed in claim 6 wherein a first portion of the mat cards have openings of a fourth predetermined size, and a second portion of the mat cards have openings of a fifth predetermined size which is different from the fourth predetermined size, so as to allow presentation of contrasting mat colors when a mat card with a larger opening is overlaid on a mat card with a smaller opening.

8. The portable model artwork gaming gallery as claimed in claim 6 further comprising a plurality of transparent protective covers of a predetennined size fitting between the mat card and the frame card.

9. The portable model artwork framing gallery as claimed in claim 6 wherein the representations of artwork images have a horizontal and a vertical dimension, and the size of the representations has been manipulated such that the vertical dimension is a predetermined height and the horizontal dimension is a predetermined width.

10. The portable model artwork framing gallery as claimed in claim 8 wherein the depiction of the frame has been manipulated such that the width of the depiction of the frame is substantially the same on each side.

11. A method of allowing selection of frames and artwork images by the use of models, which method comprises:

a) providing a plurality of representations of artwork images of a first predetermined size, from which a selection of art image can be made;

b) providing a plurality of mat cards of a second predetermined size, each of the mat cards having an internal opening sized to accommodate viewing of the representation of the selected image, from which a selection of at least one mat card can be made; and c) providing a plurality of frame cards of a third predetermined size, each card being imprinted with a frame depiction and having an opening defined by an inner border of the frame depiction which fits over at least a portion of the selected mat card, from which a selection of a complimentary representation of an artwork image, mat card and depiction of a frame can be made.

12. The method as claimed in claim 11 which further comprises providing at least one transparent protective cover of a fourth predetermined size to fit between the mat card and the frame card.

13. The method as claimed in claim 11 wherein a first portion of the mat cards has openings of a fifth predetermined size, and a second portion of the mat cards has openings of a sixth predetermined size which is different from the fifth predetermined size, so as to allow presentation of contrasting mat colors when a mat card with a larger opening is overlaid on a mat card with a smaller opening.

14. A portable model artwork image framing kit comprising in combination:

a portable container capable of holding a plurality of cards;

a plurality of representations of different artwork images of a first predetermined size, each representation centrally imprinted on the face of an artwork image card of a second predetermined size;

a plurality of mat cards, each of the mat cards being of a third predetermined size and having a central opening adapted to permit viewing of one of the representations of an artwork image when a selected one of the plurality of mat cards is overlaid on a selected one of the artwork image cards; and a plurality of frame cards of a fourth predetermined size, each imprinted with a depiction of a frame and having an opening defined by an inner border of the frame depiction which fits over at least a portion of a selected one of the mat cards, such that the selected mat card and the selected representation of an artwork image are displayed when a selected one of the frame cards is overlaid on the selected mat card and the selected representation of an artwork image card, and the predetermined sizes of the artwork image cards, the mat cards and the frame cards all fit within the container.

15. The portable model framing kit as claimed in claim 14 wherein a first portion of the mat cards have an opening of a first predetermined size, and a second portion of the mat cards have an opening of a different size.

16. The portable model framing kit as claimed in claim 14 further comprising a transparent protective cover of substantially the same exterior dimensions as the plurality of mat cards.

17. The portable model framing kit as claimed in claim 14 further comprising at least one card upon which actual samples of frames are mounted.

18. The portable model framing kit as claimed in claim 14 wherein the second predetermined size of the artwork image card, the third predetermined size of the mat card, and the fourth predetermined size of the frame card are substantially the same.

* * * * *